United States Patent [19]

Bonneau

[11] Patent Number: 4,825,479

[45] Date of Patent: May 2, 1989

[54] INFLATABLE SWIMMING POOL COVER

[76] Inventor: Pierre P. Bonneau, 866, Escuminac, Lachenaie, Quebec, Canada

[21] Appl. No.: 153,365

[22] Filed: Feb. 8, 1988

[51] Int. Cl.[4] ..... E04H 3/19

[52] U.S. Cl. ..... 4/499; 4/503; 4/504; 220/215; 220/350

[58] Field of Search ..... 4/499, 498, 500, 504, 4/503, 494; 220/215, 350; 150/52 R

[56] References Cited

U.S. PATENT DOCUMENTS

| | | | |
|---|---|---|---|
| 3,063,062 | 11/1962 | Logan | 4/172 |
| 3,676,880 | 7/1972 | Kwake | 4/172 |
| 3,747,131 | 7/1973 | Koliomichalis | 4/172 |
| 4,109,325 | 8/1978 | Shuff | 4/172 |
| 4,152,791 | 5/1979 | Rose | 4/172 |

*Primary Examiner*—Henry J. Recla
*Assistant Examiner*—Robert Fetsuga
*Attorney, Agent, or Firm*—Roland L. Morneau

[57] ABSTRACT

A sheet cover for a swimming pool adapted to become arched over the pool when air under pressure is projected under the cover. The cover has a pending skirt adapted to hang in the water adjacent the peripheral sidewall. The skirt is provided with a series of holes at a distance from its lower edge. When the cover is arched, the skirt raises until the air leaks through the holes to maintain the cover at a desired height.

11 Claims, 2 Drawing Sheets

INFLATABLE SWIMMING POOL COVER

BACKGROUND OF THE INVENTION

Field of the Invention

The swimming pool cover according to this invention is inflated with means providing a flow of air between the cover sheet and the surface of the water and is characterized by means for maintaining a constant volume of air under the cover sheet.

Background of the Invention

Inflatable covers for swimming pools are known to have various structures and functions. Canadian Pat. No. 935,347 is mainly directed to anchor means for a cover on a swimming pool. The following patents are directed to inflatable swimming pool covers but include floating devices for holding the cover.

U.S. Pat. Nos. 4,122,561, 3,747,131, 3,676,880 and Canadian Pat. No. 1,100,011.

SUMMARY OF THE INVENTION

The inflatable swimming pool cover is intended for installation on a swimming pool having vertical peripheral sidewalls. It. comprises a cover sheet impervious to air which is capable of assuming an arched configuration over the pool. A pending skirt, sealed to the periphery of the cover sheet, hangs inside and adjacent the peripheral sidewalls and is adapted to be immerged in the water in the pool. The skirt is provided with a series of aperture located at a predetermined distance from the periphery of the cover. A flow of air is projected under the cover to raise the latter. The cover sheet arches and the skirt is raised along the sidewalls until the apertures in the skirt reach the surface of the water. At that level, air starts to leak through the apertures. An equilibrium betweem the air intake and the air leaks maintains the cover in a constant arch configuration.

DETAILED DESCRIPTION OF THE DRAWING

Figure 2:
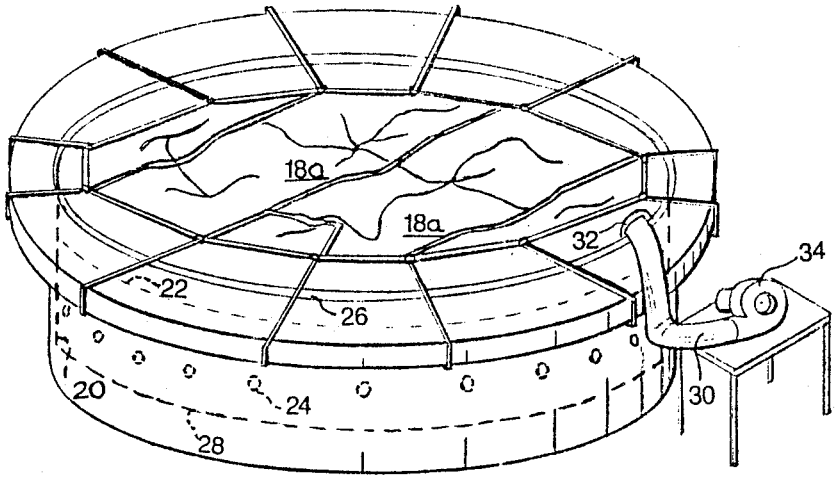
FIG. 2 is a perspective view of the cover sheet and the surrounding skirt connected to an air generator.
Figure 1:
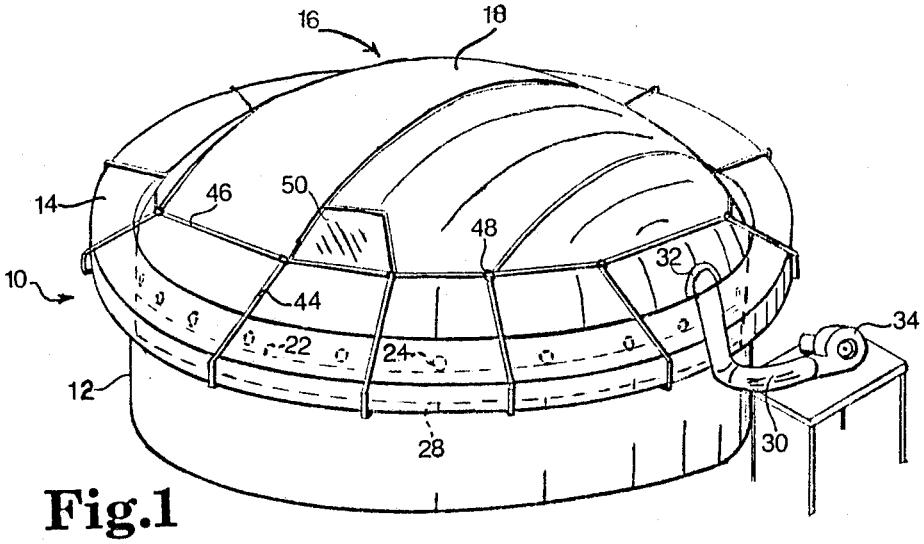
FIG. 1 is a perspective view of the cover mounted over a swimming pool above the ground.

Referring to FIG. 1, the swimming pool 10 is the above the ground type which is surrounded by a peripheral wall 12 and over which is fixed a narrow reinforcing platform 14.

The swimming pool cover generally identified by reference member 16 is made of a cover sheet 18 sealed to a peripheral skirt 20. The cover sheet 18 which has a convex shape covers the surface 22 of the water and the skirt 20 hangs in the water inside the peripheral wall 12. A series of holes 24 is provided in the skirt 20 at a predetermined distance from the upper edge 26 and lower edge 28 of the skirt 20. All the holes 24 are at a substantially equal distance from the lower edge 28.

A tubular member 30 is connected to an air intake 32 sealed in the skirt 20 for receiving air under pressure from an air pressure generator 34. The air intake 32 can also be sealed to the periphery of the sheet cover 18 without departing from this invention.

In operation, the cover sheet 18 is laid in a general horizontal way over the surface of the water 22 and the skirt 20 hangs vertically by its own weight, along the peripheral wall 12.

The space between the cover sheet 18 and the surface of the water being air tight, the air pressure generator 34 is then actuated. The cover sheet 18 becomes progressively and uniformly arched. When it is fully concave, the volume of air under the cover sheet 18 tends to increase and slowly raises the skirt 20. When the apertures 24 in the skirt 20 reach the surface 22 of the water, the air captured under the cover 16 starts to dissipate at a rate which is compensated by the inflow of air from the generator 34. The cover sheet 18 remains in a substantially stationery position over the surface of the water and at a substantially constant height. This equilibrium is obtained due to the plurality of holes 24 which act as safety valves. Due to the normal small vertical movements of the cover 16 and the surface 22 of the water, some holes are obstructed by the water, some other partly obstructed and other allowing complete passage of air therethrough.

In order to obtain and maintain the correct position of the cover 16, the air pressure coming from the generator 34 must be sufficient to lift the weight of the cover 16 at a predetermined height above the surface of the water in addition to the normal friction of the skirt 20 on the peripheral wall 12.

The air pressure must also be set so that when the apertures 24 reach the surface 22 of the water, the cover 16 will stop rising, the inflow of air through the tubular member 30 must substantially equal the outflow of air through the holes 24.

It has been found that a generator 34 having a constant flow of air can be used to obtain the desired equilibrium. Such generator takes longer to inflate the cover but provides no excess of air when the cover 16 has reached its operating position. Obviously, a variable flow of air can also be used.

Figure 5:
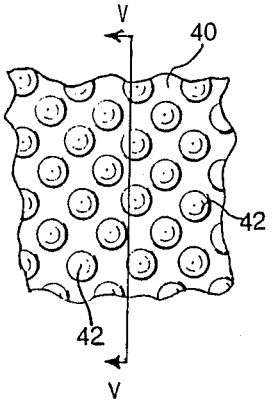
FIG. 5 is an enlarged view of a portion of the sheet cover.
Figure 6:
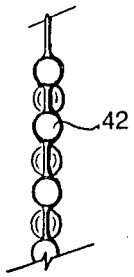
FIG. 6 is a cross-sectional view along line V—V of FIG. 5.
Figure 3:
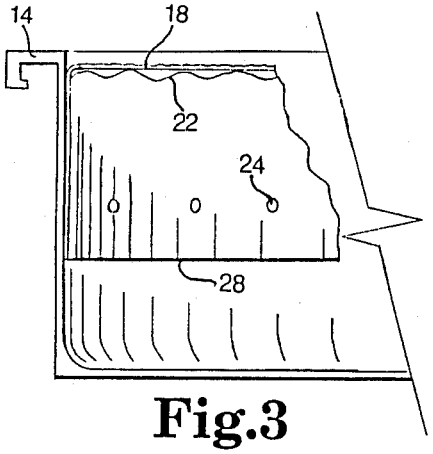
FIG. 3 is a cross-sectional view of part of the pool containing water on which lies the cover.
Figure 4:
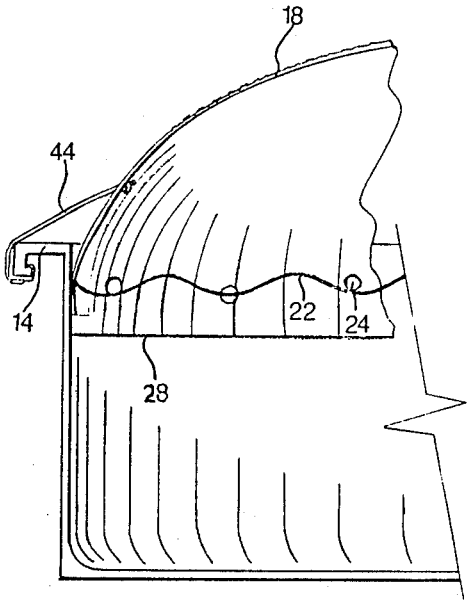
FIG. 4 is a cross-sectional view as in FIG. 3 in which the cover is arched.

In a specific example, for a swimming pool having a diameter of 18 feet, a generator supplying a constant air pressure of 150 pascals is used to project air through the tubular member 30 having a diameter of 4 in. at a rate of 120 liters per second. The cover sheet 18 used is of the type generally known and made of a solid flexible plastic 40 which contains air bubbles 42 throughout its surface as illustrated in FIGS. 5 and 6. This type of cover sheet floats on the surface of the water when not in use but has a buoyancy sufficient to also support the skirt 20. A skirt having a width of about 27 inches is made of transparent plastic sufficiently heavy to hang by itself in the water. The holes 24 are about ½ in. to one inch in diameter and located at about 6 inches from the lower edge 28 of the skirt. The holes are spaced by about 3 to 4 feet from each other. With such an arrangement, the cover 16 takes about 15 minutes to raise to its full height, which is about 4 feet at its apex above the surface of the water and takes much longer to come down.

Considering that the cover can maintain its inflated shape for a relatively long period, a person entering the pool can lift a portion of the side of the cover out of the water and slide into the pool without the cover collapsing. This operation has little effect on the general inflated shape of the cover.

Holes 24 are preferably circular but the shape of these apertures is not restricted to a circle. As a matter of fact, vertical slots in the lower edge of the skirt 20 have been succesfully used.

When inflated, the cover 16 floats on a cushion of air. In order to stabilize the cover and prevent it from rotating or being moved sideways by a breeze or the wind, the cover is anchored to the platform 14 by a series of elastic cables 44 disposed evenly around the swimming pool. The cables 44 have a hook of each end. A strip 46 of material is sewed to the cover sheet 18 along a marginal distance from the periphery of the cover sheet 18. The strip 46 is provided with a plurality of grommets 48 from which the cables 44 are hooked. This stabilizing arrangement does not maintain the cover in any rigid position but mainly provides the assurance that the cover is not carried sideways by a brisk wind.

The cover sheet 18 is generally made of contiguous strips 18*a* sealed together in such a fashion so as to correspond to a convex surface when the cover is inflated.

As stated above, the skirt 20 is made of transparent plastic. When the cover 16 is inflated, the top marginal band of the skirt 20 raises above the platform 14 and constitute a peripheral window for the people inside the pool. An additional window 50 is also foreseen in the cover sheet 18. The window 50 allows visibility at a normal height for people standing inside or outside the pool. The window 50 preferably corresponds to the position around the pool where people are more likely to come in and out of the pool and is used as the point of entrance and exit as described above. However, it is pointed out that in case of emergency, a swimmer may enter and exit from any direction around the swimming pool, between two cables 44, such a security is usually not possible in other dome-type cover for swimming pool.

The dome-type cover for swimming pool has the advantage of allowing a control of the ambiant temperature for the swimmers. When the sun shines, the fan produces a circulation of the air and when the sun is not shining, the calories from the water are not lost and maintain a comfortable ambiant temperature.

I claim:

1. An inflatable swimming pool cover for a swimming pool having a vertical peripheral sidewall, the said cover comprising a cover sheet of an air impervious flexible material capable of assuming an arched configuration over the pool, an air intake provided in the periphery of said cover for receiving air under pressure, a pending skirt sealed around said cover sheet, said skirt being made of a sufficiently heavy flat plastic material adapted to hang vertically by itself in water inside and adjacent said peripheral sidewall, said skirt being provided with a series of apertures disposed around said skirt and located at a predetermined distance above the lower edge of said skirt so as to raise above the level of the water when the cover sheet has raised to the desired arched configuration, whereby the excess air pressure coming from the air intakes leaks through at least a part of said apertures to maintain the cover sheet at a predetermined height above the water.

2. An inflatable swimming pool cover as recited in claim 1, means fixed to said cover sheet adjacent the periphery thereof for holding retaining chords, the said chords being adapted to be fixed to a plurality of location around the peripheral sidewall of the swimming pool.

3. An inflatable swimming pool cover as recited in claim 2, a reinforcing strip fixed to said cover sheet adjacent its periphery, said means for holding the retaining chords being connected to said strip.

4. An inflatable swimming pool cover as recited in claim 1, wherein said cover sheet is made of a plastic sheet comprising air bubbles sealed throughout its surface, the said bubbles allowing the said cover sheet to float on a surface of water.

5. An inflatable swimming pool cover as recited in claim 1, wherein the cover sheet has a transparent peripheral zone for allowing vision therethrough.

6. An inflatable swimming pool cover as recited in claim 1, wherein the said skirt is transparent.

7. An inflatable swimming pool cover as recited in claim 1, wherein said apertures are round holes located substantially above the lower edge of the skirt.

8. An inflatable swimming pool cover as recited claim 1, wherein the apertures have a diameter of about ½ inch to 1 inch.

9. An inflatable swimming pool cover as recited in claim 8, wherein the apertures are spaced to about three to four feet from each other.

10. An inflatable swimming pool cover as recited in claim 8, wherein the apertures are vertical slots.

11. An inflatable swimming pool cover as recited in claim 1, wherein the apertures are located at least six inches from the lower edge of said sheet.

* * * * *